United States Patent [19]

Ferland

[11] Patent Number: 4,729,202

[45] Date of Patent: Mar. 8, 1988

[54] ROOFING TILE

[76] Inventor: Edouard Ferland, 25 rue Bournival, Venise, Magog, P.Q., Canada, J1X 3W5

[21] Appl. No.: 910,380

[22] Filed: Sep. 22, 1986

[51] Int. Cl.[4] ..... E04D 1/00

[52] U.S. Cl. ..... 52/520; 52/522; 52/525; 52/536; 52/543

[58] Field of Search ..... 52/518-527, 52/543-547, 550, 552, 554, 555, 558, 559, 560, 535, 536, 539, 593; D25/80, 84

[56] References Cited

U.S. PATENT DOCUMENTS

| | | | |
|---|---|---|---|
| 330,916 | 11/1885 | Northrop | 52/521 |
| 1,515,749 | 11/1924 | Olsson | 52/523 |
| 1,597,993 | 8/1926 | Neurer | 52/529 |
| 1,638,755 | 8/1927 | Tyra | 52/521 |
| 2,004,198 | 6/1935 | Fall | 52/536 |
| 4,001,997 | 1/1977 | Saltzman | 52/521 |
| 4,040,211 | 8/1977 | Wotherspoon | 52/100 |
| 4,251,967 | 2/1981 | Hoofe, III | 52/535 |
| 4,262,466 | 4/1981 | Roe | 52/550 |
| 4,498,267 | 2/1985 | Beck | 52/555 |

FOREIGN PATENT DOCUMENTS

| | | | |
|---|---|---|---|
| 215650 | 11/1960 | Austria | 52/536 |
| 1659294 | 1/1971 | Fed. Rep. of Germany | 52/526 |
| 300934 | 9/1965 | Netherlands | 52/535 |

*Primary Examiner*—John E. Murtagh
*Assistant Examiner*—Andrew Joseph Rudy
*Attorney, Agent, or Firm*—Samuel Meerkreebs

[57] ABSTRACT

A roofing tile comprises a rectangular panel having first and second longitudinal edge portions adapted to extend in the slope direction of a sloped roof and an upper lateral edge and a lower lateral edge is adapted to run parallel to the horizontal edges of the sloped roof. The upper lateral edge and the first longitudinal edge portion has an upstanding ledge portion. The second longitudinal edge portion has a raised portion with a downwardly extending flange. The raised portion is adapted to overlap the upstanding ledge of the first longitudinal edge portion of an adjacent tile. The bottom lateral edge portion has a downwardly extending flange adapted to overlap the upstanding ledge at the upper lateral edge portion of a further adjacent tile. A lower portion of the first longitudinal edge portion is provided with fastener access means whereby a fastener can be passed therethrough to anchor the tile to the roof. The lower portion is provided with a recess defined in the panel inwardly of the upstanding ledge. The flange of the raised portion on the other longitudinal edge portion is provided with a tab adapted to tightly fit within the corresponding recess of an adjacent tile such that when a fastener anchors the lower first longitudinal edge, the tab is interlocked within the recess of the adjacent tile.

6 Claims, 6 Drawing Figures

ROOFING TILE

BACKGROUND OF THE INVENTION

1. Field of the Invention

The present invention relates to roofing tiles and in particular, to simulated clay tiles used for roofing.

The clay tiles which have been commonly used as a roofing tile for centuries in Europe are attractive, durable and resistant to most weather conditions. However, they are heavy, expensive both in terms of material and installation, and are brittle.

2. Description of the Prior Art

There have been attempts to provide simulated clay tiles such as described in U.S. Pat. No. 1,638,755, Tyra, 1927. This patent illustrates a sheet metal tile simulating a Spanish tile; U.S. Pat. No. 4,251,967, Hoofe III, 1981, describes a molded A.B.S. tile; U.S. Pat. No. 4,262,466, Roe, 1981, describes a molded concrete tile; and U.S. Pat. No. 4,498,267, Beck, 1985, describes a laminate of fiberglass reinforced gypsum and a gelcoat covering the latter layer.

It is important that the roofing tile have a construction which can easily be installed, provides a barrier to water seepage and moisture and especially when constructed of lighter weight, more flexible materials, can be securely fastened to prevent lifting due to wind.

SUMMARY OF THE INVENTION

It is an aim of the present invention to provide an improved simulated clay tile which incorporates the advantages of the above mentioned prior art, that is of being made of a material which is light, has the required strength and appearance of the clay tile yet is an improvement thereover in the sense that it has an improved construction which allows the tile to be securely fastened and provides an improved moisture and water barrier.

A roofing tile in accordance with the present invention comprises a rectangular panel having longitudinal edge portions adapted to extend in the slope direction of a sloped roof and an upper lateral edge and a lower lateral edge adapted to run parallel to the horizontal edges of the sloped roof. The upper lateral edge and one longitudinal edge portion have an upstanding ledge portion while the other longitudinal edge portion is raised with a downwardly extending flange. The raised edge portion is adapted to overlap the upstanding ledge of the one longitudinal edge portion. The bottom edge portion has a downwardly extending flange adapted to overlap the upstanding ledge at the upper edge portion. A lower portion of said one longitudinal edge portion being provided with fastener access means whereby a fastener can be passed through to anchor the tile to the roof; and the said lower portion being provided with a recess defined inwardly of the upstanding ledge. The flange of the raised portion on said other longitudinal edge portion being provided with a tab adapted to tightly fit within the corresponding recess of an adjacent tile such that when a fastener anchors the lower one longitudinal edge, the tab is interlocked within the recess.

More specifically, the tab is at a slight outward angle such that when it engages the recess, it is in frictional engagement therewith and the one longitudinal edge of the tile is raised from the roof and the one longitudinal edge is then lowered and the fastener engaged, tab is urged outwardly within the recess against a wall of the recess to interlock the tab therein.

BRIEF DESCRIPTION OF THE DRAWINGS

Having thus generally described the nature of the invention, reference will now be made to the accompanying drawings, showing by way of illustration, a preferred embodiment thereof, and in which.

DESCRIPTION OF THE PREFERRED EMBODIMENTS

Figure 1:
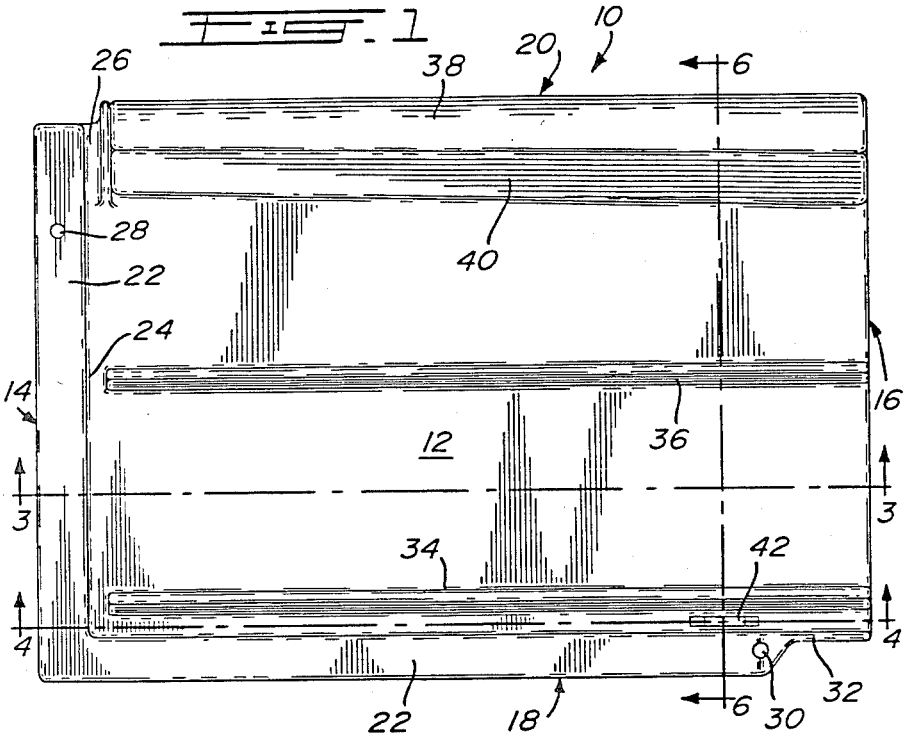
FIG. 1 is a top plan view of a tile in accordance with the present invention.
Figure 3:
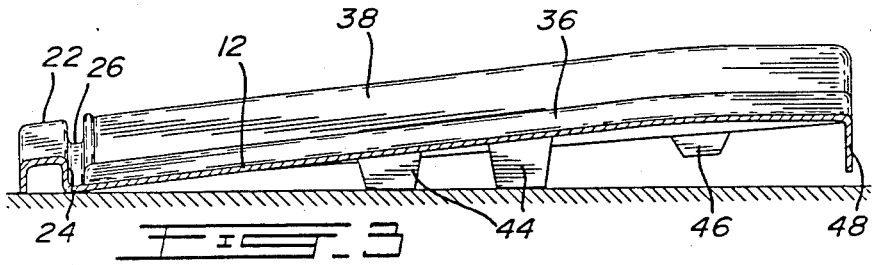
FIG. 3 is a vertical cross-section taken along lines 3—3 of FIG. 1.
Figure 4:
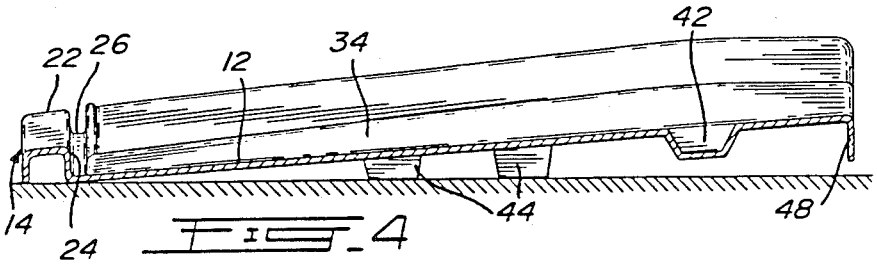
FIG. 4 is a vertical cross-section taken along lines 4—4 of FIG. 1.

Referring now to the drawings and in particular, to FIGS. 1, 3 and 4, there is illustrated a simulated tile 10, made of molded fiberglass material provided with a flat thin rectangular panel 12, having a lateral upper edge portion 14 and a lower lateral edge portion 16. Longitudinal edge portions 18 and 20 extend between the lateral edge portions 14 and 16. The lateral edge portion 14 is provided with a channel shaped upright ledge 22 having a front wall face 24, i.e., the channel opens towards the bottom as shown in FIGS. 3 and 4. The channel shaped ledge 22 extends continuously along the upper lateral edge 22 and around the longitudinal edge 18 to terminate near the longitudinal edge 16 at a cut-out portion 32. Apertures 28 and 30 are provided on the ledge 22 near diagonal opposed corners of the tile. These apertures 28 and 30 are provided to receive fastening means such as nails which pass through the apertures to anchor the tile 10 into the roof R.

The panel 12 is provided with longitudinally extending parallel ribs 34 and 36. These ribs provide ornamentation as well as strength to the panel 12.

Figure 2:
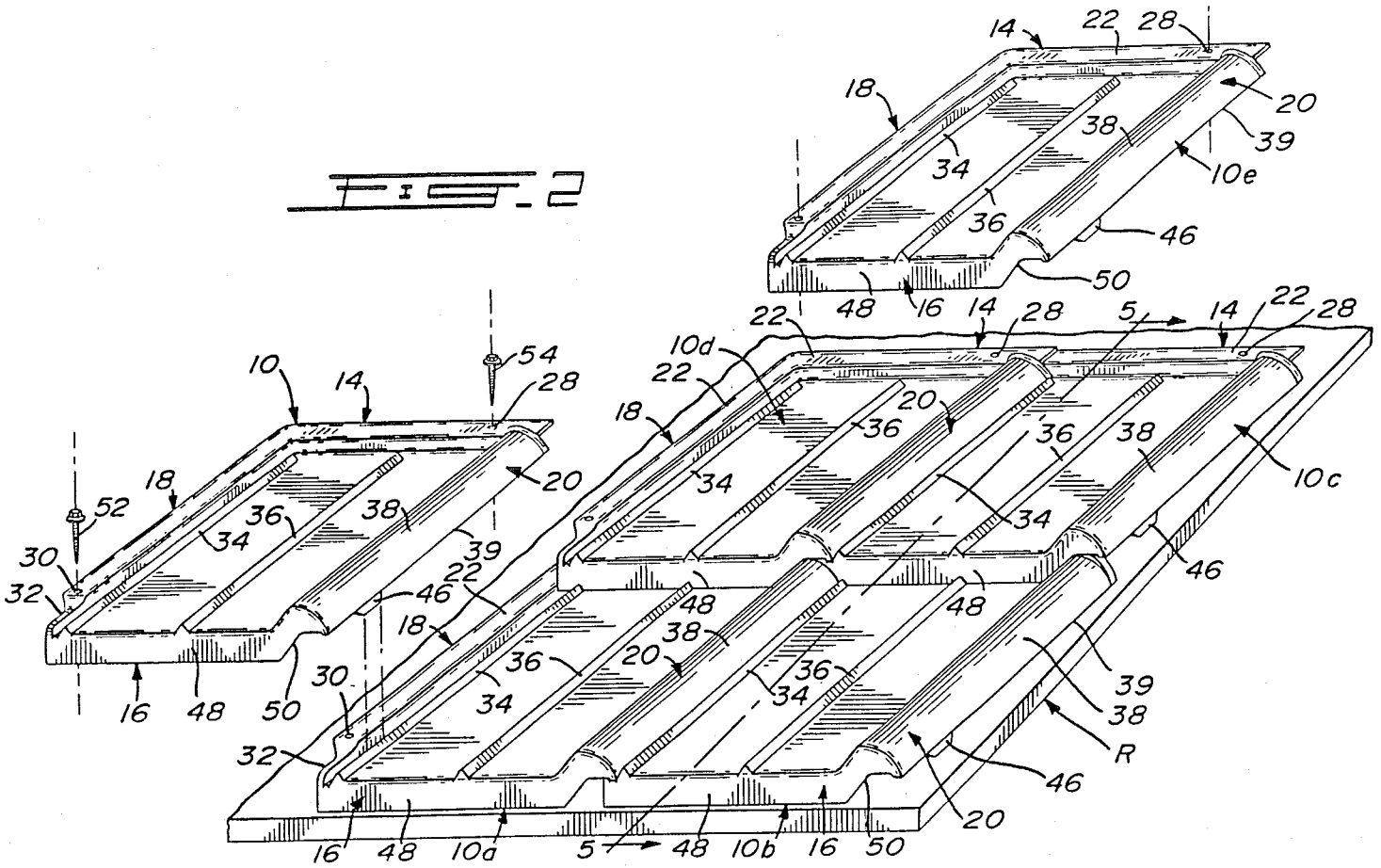
FIG. 2 is a perspective partly exploded view of tiles in accordance with the present invention in an assembled position.
Figure 5:
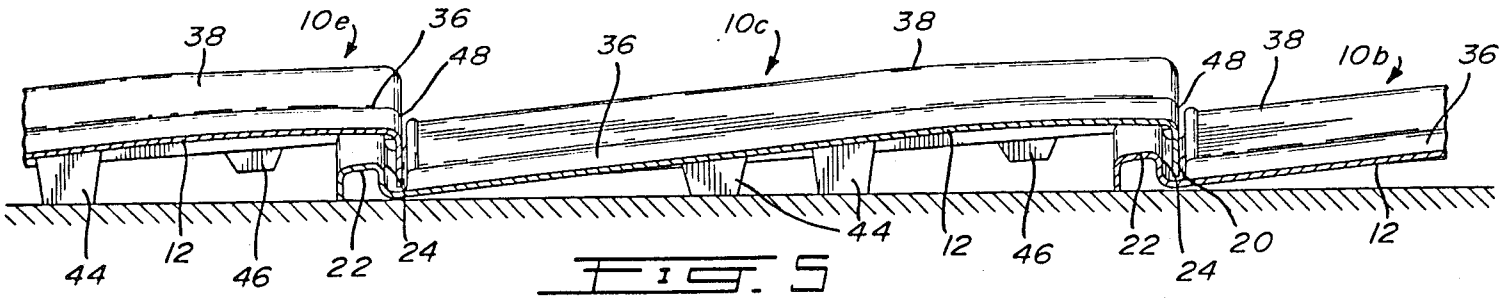
FIG. 5 is a vertical cross-section taken along lines 5—5 of FIG. 2; and, FIG. 6 is a vertical cross-sectional view of assembled tiles in the direction of lines 6—6 shown in FIG. 1.
Figure 6:
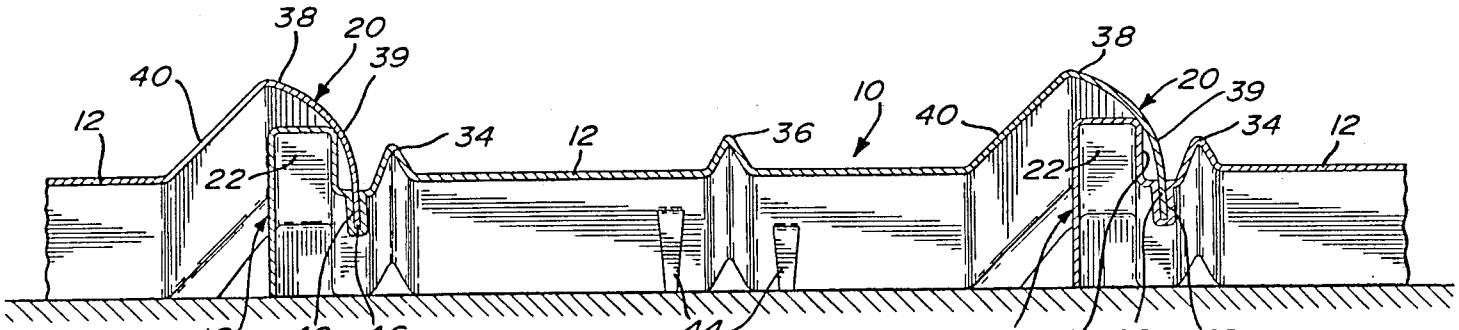

The longitudinal edge portion 20 is raised in a cylinder like portion and is identified by the numeral 38. The raised portion 38 terminates abruptly at the lower lateral edge 16 and is spaced from the upper lateral edge 14, by a groove 26. The raised portion 38 is provided with a flat surface 40 at a 45° angle to the panel 12. The raised portion 38 includes a flange 39 with a tab 46 extending downwardly from the flange 39 as shown in FIGS. 2 and 6.

The lateral lower edge 16 is provided with a downwardly extending flange 48 which is adapted to engage, as will be described, the surface of the panel 12 in front of the wall surface 24 of the outstanding ledge 22. The panel includes nibs 44 for supporting the tile powerfully on the roof surface.

A recess 42, as shown in FIGS. 1 and 4, is provided between the rib 34 and the raised channel shaped ledge 22 of the longitudinal edge portion 18. In this case, the recess 42 is provided just adjacent the aperture 30 but in the groove formed by the rib 34 and the upstanding ledge 22. The tab 46 extends from the flange 39 at an angle of approximately 6° from the vertical. The dimensions of the tab 46 correspond to the dimensions of the recess 42 such as to fit within the recess 42.

The raised portion 38 is adapted to overlap the upstanding ledge 22 of the longitudinal edge 18 with the tab 46 engaging within the recess 42 as will be described further. The tiles 10*a* through 10*e* as shown in FIG. 2 are assembled in a conventional manner with the lower lateral edges 16 overlapping the upper lateral edges 14. The lower portion of the raised portion 38 is provided with a cut-out 50 adapted to mate within the recess 26 while the flange 48 sits between the ends of ribs 34 and 36 and the front face 24 of the upstanding ledge 22 along the lateral edge 14. The flange 39 of the upstanding portion 38 likewise overlaps the upstanding ledge 22 of the longitudinal ledge 18.

When the tile 10 is assembled to an adjacent tile 10*a* for instance, the tab 46 is first aligned so that it enters the recess 42 between the rib 34 and the upstanding ledge 22. The tab 46 is snap-fitted into the recess 42 and the edge 18 is then pressed down against the resistance of the angled tab 46 within the recess 42 until it abuts against the surface of the roof and a fastener 52 is then inserted through the aperture 32 to anchor that corner of the tile 10 to the roof R. Thus, a slight torsional force is provided to the tab 46 which extends at an angle of 6° from the vertical, within the recess 42 to interlock with the recess 42. Finally, a fastener 54 is provided in the upper corner through the aperture 28 to solidly anchor the tile to the roof. Subsequent tiles in lateral and vertical rows are then overlapped and laid thereon in the manner described.

I claim:

1. A tile roof assembly made up of lightweight roofing tiles of molded plastic material, each tile comprising a rectangular panel having first and second longitudinal edge portions adapted to extend in slope direction of a sloped roof and an upper lateral edge and a lower lateral edge adapted to run parallel to the horizontal edges of the sloped roof; the upper lateral edge and the first longitudinal edge portion having an upstanding ledge portion, the second longitudinal edge portion having a raised portion with a downwardly extending flange, the raised portion being adapted to overlap the upstanding ledge of the first longitudinal edge portion of a first adjacent tile; the bottom lateral edge portion having a downwardly extending flange adapted to overlap the upstanding ledge at the upper lateral edge portion of a further adjacent tile; a lower portion of said one longitudinal edge portion being provided with fastener access means whereby a fastener can be passed therethrough to anchor the tile to the roof, the flange of said raised portion on said second longitudinal edge portion being provided with a tab extending downwardly from the flange, slightly angled outwardly from the tile panel to tightly fit within a corresponding recess defined in the first adjacent tile at a right angle to the plane of the panel such that when a fastener anchors the lower one horizontal edge, the tab is thus interlocked within the recess of the adjacent tile.

2. A roofing tile as defined in claim 1 wherein the tab being at a slight outward angle is in frictional engagement with the recess such that when the one longitudinal edge of the tile is lowered to be anchored to the roof by a fastener, the tab is urged outwardly within the recess against the wall of the recess to interlock the tab therewith.

3. A roofing tile as defined in claim 2, wherein a second fastener access means is provided in a diagonally opposite corner of the tile.

4. A roofing tile as defined in claim 1, wherein the lower lateral edge portion is cut away to receive the upper diagonally opposed corner of a diagonally adjacent tile.

5. A roofing tile as defined in claim 1, wherein the second longitudinal edge is provided with a raised partially cylindrical portion with a flange extending downward therefrom to engage the top surface of the first adjacent tile panel inwardly of the upstanding ledge thereof.

6. A roofing tile as defined in claim 1, wherein the upstanding ledge is in the form of a continuous channel extending about the said first longitudinal edge and the upper lateral edge, the channel being opened downwardly.

* * * * *